US008186437B2

(12) United States Patent
Xu et al.

(10) Patent No.: US 8,186,437 B2
(45) **Date of Patent: *May 29, 2012**

(54) ASSEMBLY FOR CONTROLLED DELIVERY OF DOWNHOLE TREATMENT FLUID

(75) Inventors: Zheng Rong Xu, Sugar Land, TX (US); Jorge A. Lozada Pazzi, Villahermosa (MX); Kevin Odom, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 92 days.

This patent is subject to a terminal disclaimer.

(21) Appl. No.: 12/627,273

(22) Filed: Nov. 30, 2009

(65) Prior Publication Data

US 2010/0186967 A1 Jul. 29, 2010

Related U.S. Application Data

(63) Continuation-in-part of application No. 12/487,376, filed on Jun. 18, 2009.

(60) Provisional application No. 61/148,240, filed on Jan. 29, 2009.

(51) Int. Cl.
*E21B 43/16* (2006.01)

(52) U.S. Cl. ..... 166/305.1; 166/177.4; 166/285

(58) Field of Classification Search ..... 166/305.1, 166/177.4, 289, 285, 290
See application file for complete search history.

(56) References Cited

U.S. PATENT DOCUMENTS

| | | | | |
|---|---|---|---|---|
| 1,526,581 | A | 2/1925 | Bache | |
| 2,407,983 | A * | 9/1946 | Harper | 166/289 |
| 2,646,125 | A * | 7/1953 | Hall | 166/154 |
| 2,822,051 | A * | 2/1958 | Lamberson, Jr. et al. | 166/325 |
| 2,848,053 | A * | 8/1958 | Curry | 166/325 |
| 2,907,392 | A * | 10/1959 | Ormsby | 166/325 |
| 3,358,770 | A * | 12/1967 | Zandmer | 166/317 |
| 4,068,712 | A * | 1/1978 | Stump | 166/156 |
| 4,842,069 | A * | 6/1989 | Baugh et al. | 166/285 |
| 2008/0173446 | A1 * | 7/2008 | Unsgaard et al. | 166/265 |

* cited by examiner

*Primary Examiner* — Nicole Coy
(74) *Attorney, Agent, or Firm* — Michael L. Flynn; Robin Nava; Rodney Warfford

(57) ABSTRACT

An assembly for delivery of treatment fluid at a target location downhole. The assembly is configured to avoid any substantial loss of treatment fluid in advance of reaching the target location in spite of low well pressure or a potentially excessive depth of the location. The assembly also allows for loading with treatment fluid from a downhole end thereof so as to avoid driving treatment fluid through the entirety of a tubular accommodating the assembly. The assembly may employ a spot valve to enhance filling with treatment fluid along with a backpressure valve coupled to the spot valve on-site so as to avoid premature loss of treatment fluid during a delivery application.

22 Claims, 5 Drawing Sheets

ASSEMBLY FOR CONTROLLED DELIVERY OF DOWNHOLE TREATMENT FLUID

CROSS REFERENCE TO RELATED APPLICATION(S)

This Patent Document is a Continuation in Part of co-pending U.S. patent application Ser. No. 12/487,376 entitled Assembly for Controlled Delivery of Downhole Treatment Fluid, filed on Jun. 18, 2009, which in turn is entitled to the benefit of, and claims priority under 35 U.S.C. §119(e) to U.S. Provisional Application Ser. No. 61/148,240, entitled Precision Placement of a Treatment Fluid in Low Bottom Hole Pressure Wells, filed on Jan. 29, 2009, the entire disclosures of each of which are incorporated herein by reference.

FIELD OF THE INVENTION

Embodiments described relate to tools and techniques for delivering treatment fluids to downhole well locations. In particular, embodiments are described of tools and techniques for delivering treatment fluids to downhole locations of low pressure bottom hole wells. The tools and techniques are directed at achieving a degree of precision with respect to treatment fluid delivery to such downhole locations.

BACKGROUND OF THE RELATED ART

Exploring, drilling and completing hydrocarbon and other wells are generally complicated, time consuming, and ultimately very expensive endeavors. As a result, over the years, a tremendous amount of added emphasis has been placed on monitoring and maintaining wells throughout their productive lives. Well monitoring and maintenance may be directed at maximizing production as well as extending well life. In the case of well monitoring, logging and other applications may be utilized which provide temperature, pressure and other production related information. In the case of well maintenance, a host of interventional applications may come into play. For example, perforations may be induced in the wall of the well, regions of the well closed off, debris or tools and equipment removed that have become stuck downhole, etc. Additionally, in some cases the well may be repaired or treated by the introduction of downhole treatment fluids such as cement for plugging a region of the well or perforations thereof.

With respect to the delivery of downhole treatment fluid, several thousand feet of coiled tubing or other tubular equipment may be brought to the well site at an oilfield. This may be achieved by appropriate positioning of a coiled tubing reel near the well, for example with a coiled tubing truck and delivery equipment. Generally, a downhole end of the coiled tubing may be preloaded with the treatment fluid whereas a more inert driving fluid such as water is located immediately uphole of the treatment fluid. A spot valve may be located at the downhole end of the coiled tubing so as to help ensure that the loaded fluids do not prematurely leak back out of the downhole end of the coiled tubing.

The loaded coiled tubing may be deployed from the reel at the surface of the oilfield and into the well. With the downhole end of the coiled tubing being first to reach the region of the well for treatment, advancement of the coiled tubing may be stopped. In theory, pressure within the coiled tubing may then be driven up by a surface pump in order to overcome the retaining capacity of the spot valve. Thus, the treatment fluid may be delivered to the noted well region.

Unfortunately, while a conventional spot valve is particularly adept at ensuring proper filling of the downhole end of the coiled tubing with the noted treatment fluids, it is generally limited in the amount of fluid pressure which it may ultimately retain. For example, a conventional spot valve may be rated to sufficiently hold back about 500 psi in the downhole end of the coiled tubing. This may be more than enough capacity to hold back a column of cement for a standard cementing treatment application. However, as noted above, the coiled tubing is loaded with treatment fluid in the downhole end with an additional driving fluid occupying the coiled tubing immediately above the treatment fluid. Thus, the spot valve is ultimately relied upon to hold back the treatment fluid as well as perhaps several thousand additional columnar feet of driving fluid upon full deployment of the coiled tubing. Thus, depending on the differential pressure between the well and the column of fluid in the coiled tubing, the likelihood of the spot valve failing may be quite significant.

Considering the ever increasing well depths and corresponding larger fluid columns of the coiled tubing, the likelihood of premature spot valve failure is quite significant, particularly where low bottom hole pressure wells are concerned. For example, where the treatment region of the well is located 15,000 to 20,000 feet below surface, the ability of a 500 psi rated spot valve to hold back a fluid column of such a depth is highly dependent upon the surrounding pressure in the well. That is, pressure at the interior of the spot valve is likely to be close to say about 2,000 psi in such a circumstance. Thus, so long as the pressure in the well remains above 1,500 psi, premature leaking of the spot valve may be avoided. In a low bottom hole pressure well, however, say a 1,000 psi well in the present spot valve example, the differential pressure would be insufficient to prevent failure of the valve. Rather, the spot valve would fail uphole of the treatment region, once 1,500 psi had built up interior thereof (e.g. overcoming the 500 psi of the spot valve plus the 1,000 psi of well pressure).

Such a failure of the spot valve as noted may have extremely negative consequences which go beyond the mere time lost in running an ineffective fluid treatment application. For example, release of a treatment fluid such as cement uphole of the targeted region may leave productive well regions contaminated or clogged with cement. Thus, in addition to re-running the application, additional time may be lost in first cleaning out the unintentionally cemented areas of the well. Ultimately, premature failure of the spot valve may cost up to a day or more of lost time at a cost of potentially several hundred thousand dollars.

Given the potential consequences of premature spot valve failure, attempts have been made to load the coiled tubing with treatment fluid from surface only once the coiled tubing reaches the targeted well region. In theory this would avoid the possibility of valve failure and premature treatment fluid delivery. Unfortunately, this means that a harsh treatment fluid such as cement needs to be pumped through several thousand feet of narrow coiled tubing. This adds a significant amount of time to the application and raises the possibility of the treatment fluid becoming contaminated with driving fluid. Thus, even in the case of low bottom hole pressure wells, the technique of preloading the downhole end of the coiled tubing with treatment fluid and hoping for the best out of the spot valve is generally considered the most practical option available to the operator.

SUMMARY

A tubular assembly is provided for controlling delivery of a downhole treatment fluid. The assembly includes a tubular body to accommodate the fluid. A spot valve is disposed at the downhole end of the tubular body in order to manage the manner in which the fluid is accommodated by the body. Additionally, a backpressure valve is coupled to the downhole end of the spot valve so as to adequately manage the controlling of the delivery of the fluid.

DETAILED DESCRIPTION

Embodiments are described with reference to certain downhole applications. For example, in the embodiments depicted herein, a downhole cementing application is depicted in detail via coiled tubing delivery. However, a variety of other application types may employ embodiments of treatment fluid assemblies and techniques as described herein. For example, precision delivery of alternative treatment fluids through coiled tubing and/or other tubular devices may be achieved through practice of embodiments described herein. Regardless, the embodiments may include the unique combination of spot and backpressure valves disposed at the downhole end of a tubular for its respective filling and dispensing of treatment fluid.

Figure 1:
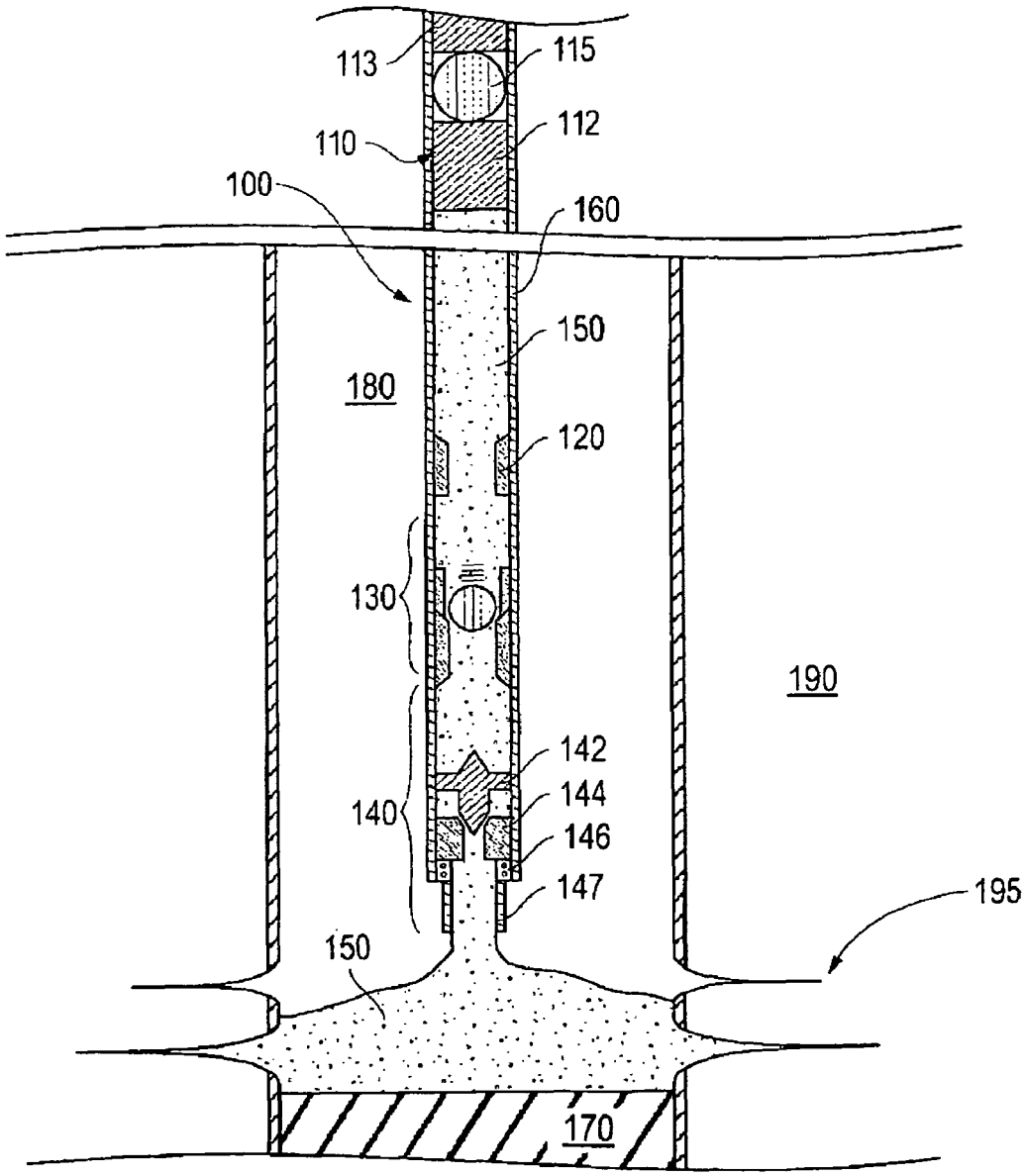
FIG. 1 is a cross-sectional view of an embodiment of an assembly for controlled delivery of downhole treatment fluid in a well.

Referring now to FIG. 1, an assembly 100 for controlled delivery of downhole treatment fluid 150 within a well 180 is depicted. The assembly 100 is configured to avoid premature release of treatment fluid 150 and ensure that the fluid 150 is delivered to a predetermined location downhole. As indicated, this may be achieved through the unique combination of a spot valve 130 and a backpressure valve 140 incorporated into the assembly 100. As depicted, the assembly 100 is incorporated into the downhole end of a tubular such as coiled tubing 160. In the embodiment shown, the treatment fluid 150 is a conventional downhole cement mixture that is employed for occluding perforations 195 at the noted predetermined location. However, other treatment applications may employ an assembly 100 and techniques as detailed herein. With particular reference to the application depicted in FIG. 1, the well 180 may traverse several thousand feet through a formation 190 before reaching the location of the perforation 195. Thus, the pressure imparted on the valves 130, 140 from a fluid column of treatment 150 and driving 350 fluids may be quite significant (see also FIG. 3A). For example, in one embodiment, this pressure may exceed the threshold of the spot valve 130, perhaps about 500 psi, as well as the surrounding pressure of the well 180. Nevertheless, the backpressure valve 140 may be of sufficient tolerance so as to avoid premature release of treatment fluid 150.

Continuing with reference to FIG. 1, the cementing application depicted reveals a packer 170 prepositioned below the perforations 195. As such, the coiled tubing 160 may be deployed for positioning the assembly 100 above the packer 170 and releasing the treatment fluid 150 thereat. The assembly 100 is configured with a backpressure valve 140 to ensure that premature release of the fluid 150 is avoided while also employing a spot valve 130 to allow for filling of the coiled tubing 160 from a downhole end as detailed further below. Thus, the treatment fluid 150 may be delivered with a degree of precision while avoiding the need to load the coiled tubing 160 from a surface end thereof, potentially several thousand feet away from the delivery location. As such, the fluid 150 need not be run through the entire coiled tubing 160 in order to achieve a reliable degree of precision in delivery.

Figure 2:
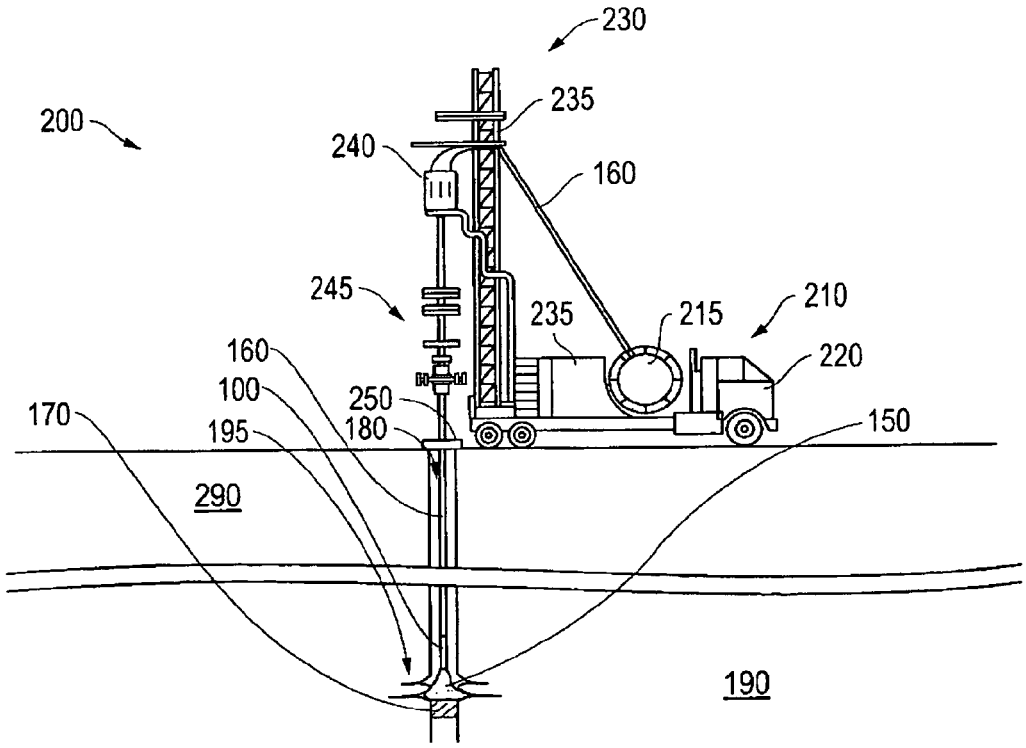
FIG. 2 is a perspective overview of an oilfield accommodating the well of FIG. 1 with the assembly disposed therein.

Continuing with added reference to FIG. 2, the assembly 100 is shown deployed within the well 180 via conventional coiled tubing 160 as in FIG. 1. However, FIG. 2 also reveals an overview of an oilfield 200 with coiled tubing equipment 210 and a rig 230 positioned for the noted coiled tubing deployment. In the embodiment shown, the equipment 210 includes a coiled tubing truck 220 for readily mobile positioning of a coiled tubing reel 215 and control unit 235. However, in other embodiments, a conventional skid or other positioning equipment may be employed.

In the embodiment of FIG. 2, a rig 230 is secured to the coiled tubing truck 220, complete with a conventional injector 240. Again, however, alternative equipment and techniques may be employed, such as an injector which stands independent of the coiled tubing equipment 210. Regardless, the depicted injector 240 is coupled to valve and pressure regulating mechanics such as a conventional Christmas tree 245 configured for guided advancement of the coiled tubing 160 through the well 180.

As shown in FIG. 2, the coiled tubing 160 with assembly 100 at the end thereof, may advance through the well 180 and various formation layers 290, 190 before reaching the targeted location for release of treatment fluid 150. Thus, the coiled tubing 160 and assembly 100 may traverse several thousand feet before reaching the targeted location (i.e. above the depicted packer 170). Nevertheless, the treatment fluid 150 is adequately retained by the assembly 100 until the targeted location is reached. Indeed, the incorporation of spot 130 and backpressure 140 valves into the assembly 100 enhances the loading of treatment fluid 150 while also preventing its premature release (see FIG. 1). This remains the case, even in circumstances where the well 180 is of substantially low pressure, particularly as compared to pressure in the assembly 100.

Returning now to FIG. 1, the mechanics of the above noted valves 130, 140 are detailed. Additionally, a pig assemblage 110 is described for separating treatment 150 and driving 350 fluids (see FIG. 3A). The spot valve 130 is a conventional one way valve of limited pressure tolerance. For example, as described above and detailed further below, the spot valve 130 may be configured to allow loading of treatment fluid 150 into the assembly 100 and coiled tubing 160 from a downhole end thereof. As shown in FIG. 1, a pig assemblage 110 is provided within the coiled tubing 160 for interfacing the influx of loading treatment fluid 150. Namely, a downhole pig 112 slidably interfaces the fluid 150 as guided by a guiding ball 115. The guiding ball 115 is in turn separated from a driving fluid 350 by an uphole pig 113 as detailed further below (see FIG. 3A). Following the influx of treatment fluid 150, the spot valve 130 may return to a naturally closed position. With the valve 130 in the closed position, the treatment fluid 150 may be held in place until forced open by induced pressure within the assembly 100. That is, the ball of the spot valve 130 normally rests on its seat. The seat is held fixedly with respect to the coiled tubing 160 by one or more shear pins. A sufficient influx of pressure within the assembly 100 may shear the shear pins, causing the seat to move downwardly relative to the coiled tubing 160. The ball of the spot valve 130 however, is "caught" by a ball catcher or other similar mechanism that prevents the ball from moving downwardly with the seat. As such, the spot valve 130 is in an open position and the treatment fluid is allowed to flow past the spot valve 130.

Given the potential depth of the targeted location within the well 180 for delivery of the treatment fluid 150, the naturally escalating column of fluid and pressure within the assembly 100 may exceed the tolerances of the spot valve 130. Therefore, to ensure that the treatment fluid 150 is held in place until the assembly 100 is positioned at the treatment location as depicted in FIG. 1, the noted backpressure valve 140 is provided. The backpressure valve 140 is equipped with a valve seat 144 which is actuated by a spring 146 for interfacing with a valve head 142.

The above noted spring 146 may be set to a wide range of pressure tolerances, generally far exceeding those of the spot valve 130. For example, in one embodiment, the spring 146 may have a threshold of about 3,000 psi whereas the spot valve 130 is set at closer to about 500 psi. Thus, in a low pressure well 180 of say about 1,000 psi, over 4,500 psi may be induced at the assembly 100 through a combination of surface pumping and the natural column of fluid pressure through the coiled tubing 160 so as to deliver the treatment fluid 150 as shown. That is, at about 4,500 psi, the resistance of the spring 146 (3,000 psi), the spot valve 130 (500 psi) and the well 180 (1,000 psi) may start to be overcome. By the same token, however, barring such induced pressure, the treatment fluid 150 may remain securely within the assembly 100 until the targeted location is reached.

Figure 3A:
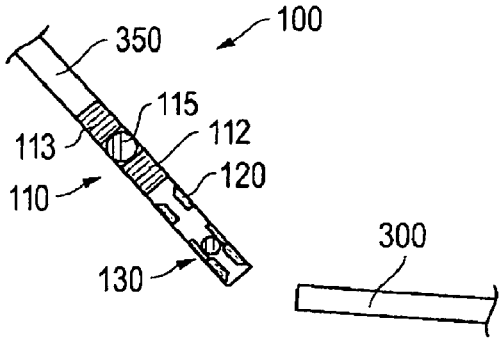
FIG. 3A is a side cross sectional view of the assembly of FIG. 1 with a spot valve configured for coupling to a treatment fluid line.
Figure 3B:
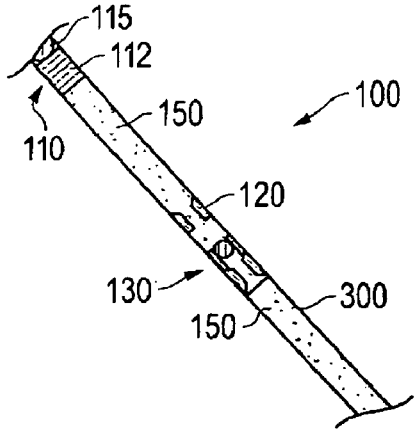
FIG. 3B is a side cross sectional view of the assembly of FIG. 3A obtaining treatment fluid from the treatment fluid line.
Figure 3C:
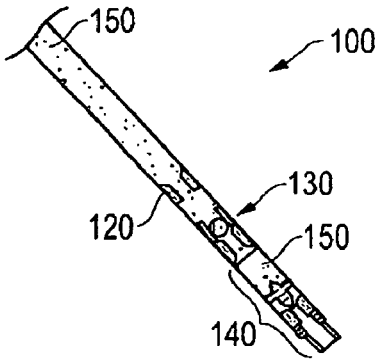
FIG. 3C is a side cross sectional view of the assembly of FIG. 3B with a backpressure valve coupled to the spot valve for retaining treatment fluid.

The depiction of the assembly 100 of FIG. 1 as described above, reveals a manner in which the treatment fluid 150 may be delivered to the desired location while substantially avoiding the possibility of premature release of the fluid 150. Similarly, FIG. 4, described below, further details the mechanics of completing the delivery of the treatment fluid 150, particularly as such relates to the above noted pig assemblage 110. FIGS. 3A-3C, on the other hand, detail the manner in which the coiled tubing and assembly 100 may initially be loaded with treatment fluid 150. As described below, the pig assemblage 110 may also serve to aid in loading of the treatment fluid 150 in conjunction with the spot valve 130 as alluded to above.

Continuing with reference to FIGS. 3A-3C, loading of the assembly 100 and coiled tubing with treatment fluid 150 is described in greater detail. With respect to FIG. 3A in particular, the pig assemblage 110 is shown with driving fluid 350 in the coiled tubing 160 interfacing the uphole pig 113. The uphole pig 113 is of a conventional compressible polymer or other suitable material having a non-compressed diameter slightly in excess of the inner diameter of the coiled tubing 160. As such, the pig 113 may be squeezed into a slidable but substantially sealing engagement within the coiled tubing 160 as depicted. Additionally, the uphole pig 113 may be substantially non-porous at each end, particularly the uphole end, to help avoid leakage of driving fluid 350 past the pig assemblage 110 in a downhole direction.

Similar to the uphole pig 113, the downhole pig 112 may be of a conventional compressible polymer or other suitable material and of a diameter similar to that of the uphole pig 113. Additionally, non-porous ends of the downhole pig 112 may be employed (particularly at the downhole end of the pig 112). However, with reference to FIG. 3B as described further below, such non-porous ends may be employed so as to help avoid leakage of treatment fluid 150 past the pig assemblage 110 in an uphole direction.

In the embodiment shown, a guiding ball 115 may be disposed between the pigs 112, 113. As treatment fluid 150 is loaded into the coiled tubing 160 and delivery assembly 100, the pig assemblage 110 may be slidably shifted uphole whereas dispensing of the treatment fluid 150 may result in a downhole shift of the pig assemblage 110. In one embodiment the guiding ball 115 is of stainless steel. However, other suitable materials may be employed. Additionally, as detailed with respect to FIG. 4 below, the guiding ball 115 may interface with a delivery stop seat 120 upon completed delivery of treatment fluid 150. At this point, the downhole pig 112 may pass downhole of the seat 120 and disintegrate while the guiding ball 115 serves to stop downhole movement of the driving fluid 350 and uphole pig 113. Thus, driving fluid 350 is prevented from leaving the assembly 100.

The assembly 100 is also equipped with the noted spot valve 130 which is configured to allow an influx of treatment fluid 150 into the assembly 100. Thus, as shown in FIG. 3A, a treatment fluid line 300 is depicted which may be coupled to the assembly 100 at the downhole end of the spot valve 130. Indeed, as shown in FIG. 3B, the line 300 is coupled to the valve 130 and a treatment fluid 150 such as cement is pumped past the assembly 100 and into the coiled tubing 160.

Figure 4:
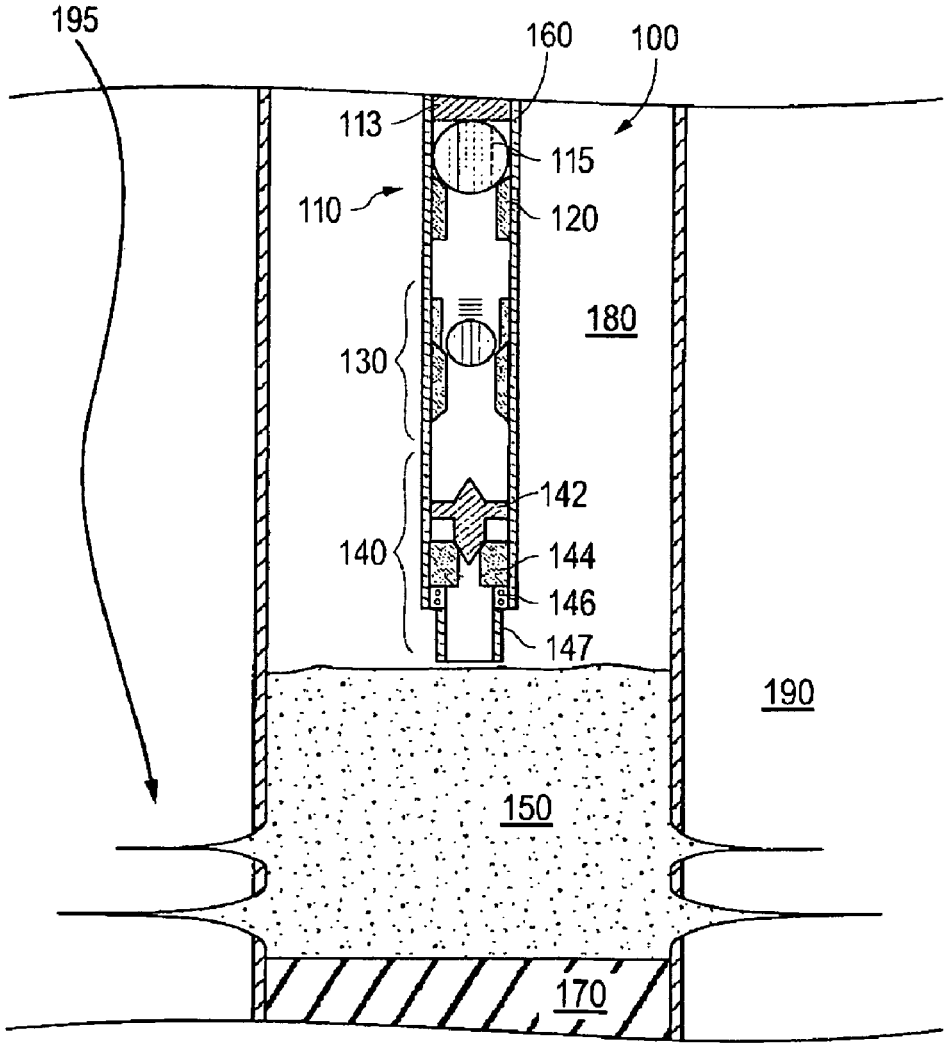
FIG. 4 is a cross-sectional view of the assembly of FIG. 1 following the controlled delivery of treatment fluid in the well.

Continuing with reference to FIG. 3B, the influx of treatment fluid 150 from the fluid line 300 not only opens the one-way spot valve 130, but also drives the pig assemblage 110. However, due to the slidable sealing nature of the pig assemblage 110 as described above, the treatment fluid 150 is left substantially uncontaminated by any driving fluid 350 within the coiled tubing 160 and vice versa. Thus, treatment applications such as depicted in FIGS. 1, 2, and 4, may proceed with a degree of reliability as to the makeup of the treatment fluid 150 delivered. Furthermore, the majority of the interior of the coiled tubing 160 is largely unaffected by the potentially harsh nature of treatment fluid 150 such as cement. Indeed, due to the loading of the treatment fluid 150 from the downhole end of the coiled tubing 160, the substantial majority of the coiled tubing 160 is never even exposed to the treatment fluid 150.

Continuing now with reference to FIG. 3C, the assembly 100 is shown with the treatment fluid line 300 removed and the spot valve 130 in a closed position. However, given the limited pressure rating of the spot valve 130, the assembly 100 is also equipped with the above-noted backpressure valve 140. Thus, the treatment fluid 150 may be adequately retained until intended delivery. So, whereas the spot valve 130 is configured to allow effective one-way loading of the assembly 100 and coiled tubing 160, the backpressure valve 140 may be employed after loading to ensure that the treatment fluid 150 is not unintentionally leaked. In one embodiment the backpressure valve 140 is set to open at between about 2,000 psi and about 5,000 psi. That is, where the pressure differential reaches somewhere between 2,000 and 5,000 psi between the outside environment (e.g. the well 180 of FIGS. 1, 2, and 4) and that immediately uphole of the valve 140, the valve 140 will begin to open. This is in stark contrast to a one-way spot valve 130 which, as a practical matter, will generally have a pressure rating of less than about 1,000 psi.

The addition of the backpressure valve 140 following loading of the assembly 100 as depicted in FIG. 3C, means that an operator may select the pressure rating of the valve 140 at the time of the operation. For example, with added reference to FIG. 2, each treatment operation may have its own independent set of variables such as the pressure in the well 180 and delivery depth for the treatment fluid 150. As such, the pressure differential between the well 180 and the interior of the coiled tubing 160 at the assembly 100 may vary from operation to operation. However, given that loading of treatment fluid 150 and placement of the backpressure valve 140 may take place on site at the oilfield 200, the operator has the opportunity to select a readily available 'off the shelf' backpressure valve 140 that best suits the expected pressure differential for the individual operation.

In an exemplary operation as alluded to above, a 500 psi rating for the spot valve 130 may be factored in along with 1,000 psi of pressure in the well 180, and a fluid column of 3,000 psi at the assembly 100 when positioned at the downhole delivery location. Thus, the operator is faced with an expected pressure differential of about 1,500 psi and may select a backpressure valve 140 having a rating of at least about 1,500 psi. In one such embodiment, the operator may select a backpressure valve 140 having a rating that exceeds the pressure differential by at least about 500 psi (e.g. 2,000 psi rated backpressure valve 140 in the example described here).

In certain operations, the expected pressure differential may exceed standard readily available backpressure valve pressure ratings. However, in these circumstances, multiple backpressure valves may be employed in series following treatment fluid loading. For example, in a circumstance where a differential of about 7,000 psi is expected, two 4,000 psi rated backpressure valves may be linked to one another at the downhole end of the spot valve 130. Thus, upon reaching the delivery site, 1,000 psi of pressure may be induced from surface to initiate delivery of treatment fluid 150. In this manner, additional benefits of on-site customization of the assembly 100 may be realized.

Continuing now with reference to FIG. 4, the completed delivery of the treatment fluid 150 is depicted. In the embodiment shown, the treatment fluid 150 is a standard downhole cement that is employed for closing off a section of the well 180, particularly, perforations 195 thereof. Upon completion of the delivery, the downhole pig 112 of FIG. 1 is forced beyond the delivery stop seat 120 and disintegrates. Thus, the guiding ball 115 comes to a rest at the seat 120 holding back the uphole pig 113 and driving fluid 350 thereabove (see FIG. 3A). As a result, fluid pressure on both the spot valve 130 and the backpressure valve 140 stops, thereby allowing the valves 130, 140 to return to a closed position. Additionally, the stop of fluid flow may be detected at surface in the form of a sudden spike in pressure in light of the ongoing pumping of driving fluid 350 into the coiled tubing 160. When this occurs, the operator is alerted that delivery of treatment fluid 150 is complete, and pumping of driving fluid 350 may be halted.

Figure 5:
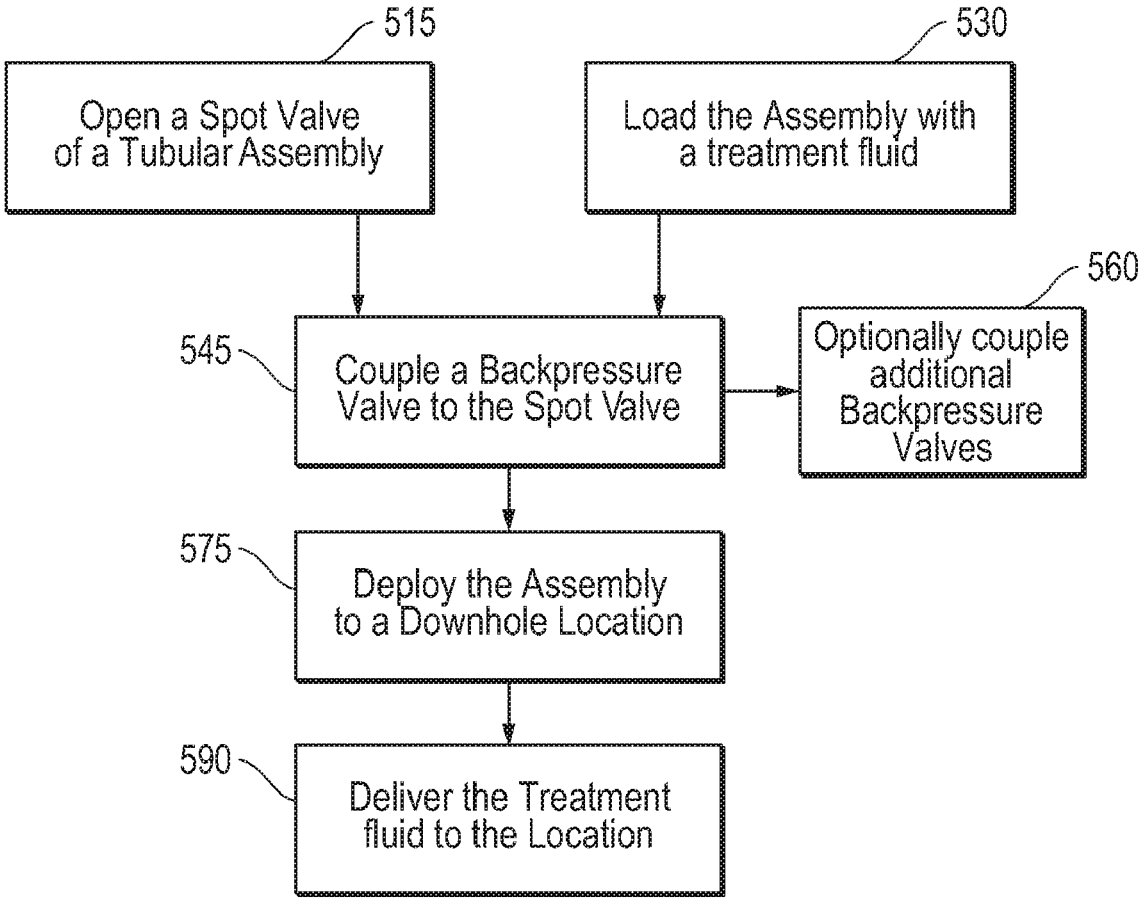
FIG. 5 is a flow chart summarizing embodiments of employing an assembly for controlled delivery of downhole treatment fluid.

Referring now to FIG. 5, a flow-chart summarizing embodiments of employing an assembly for controlled delivery of downhole treatment fluid is depicted. As indicated at 515, a spot valve configured for one-way influx of fluid under limited pressure is opened. Indeed, the opening of the spot valve may be in conjunction with the loading of an assembly housing the valve with treatment fluid as noted at 530. While the spot valve is configured for one way flow under the limited pressure of loading, a backpressure valve is coupled to the spot valve as indicated at 545. In this manner, subsequent exposure to much higher amounts of fluid pressure won't result in leakage of treatment fluid from the assembly. Additionally, as a matter of user friendliness, backpressure valves may be employed which are of standard, off the shelf, pressure ratings. Where required to prevent premature treatment fluid leakage, particularly in low bottom hole pressure wells, multiple such backpressure valves in series may be employed (see 560).

The assembly may then be deployed by way of coiled tubing or other available tubular delivery mechanism. Once deployed as indicated at 575, sufficient pressure to overcome the backpressure valves) may be imparted on the assembly via surface equipment at the oilfield. As such, treatment fluid may be delivered to the proper downhole location as noted at 590 while substantially avoiding premature treatment fluid release. With added reference to FIG. 4, the delivery of treatment fluid 150 in the form of cement may be delivered according to such techniques in order to close off a portion of a well 180 and perforations 195. Additionally, in one embodiment, subsequent milling through the delivered cement may be employed to provide access to locations of the well 180 below the perforations 195 while leaving the perforations 195 themselves occluded.

Embodiments described hereinabove include assemblies and techniques that substantially eliminate the possibility of premature release to treatment fluid within a well. This is the case in spite of ever increasing well depths and treatment locations which place added pressure on delivery assemblies, particularly in the case of low bottom hole pressure wells. Furthermore, these assemblies and techniques avoid loading of tubulars with treatment fluids from the surface end at an oilfield, only to require that the fluids traverse several thousand tubular feet in order to reach a downhole delivery location. Thus, the integrity of the treatment fluids as well as the tubulars remain substantially uncompromised. Furthermore, no significant additional time or risk is presented to the operator in employing embodiments of delivery assemblies and techniques as detailed herein. In fact, the operator is even afforded a degree of user friendliness heretofore unavailable in terms of allowing on-site customization of the delivery assembly to be employed.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal particular coiled tubing cementing applications. However, other types of treatment fluid applications may employ embodiments and techniques as detailed herein. Indeed, tubulars other than coiled tubing may be employed in delivering the treatment fluid. Furthermore, the foregoing description should not be read as pertaining only to the precise structures described and shown in the accompanying drawings, but rather should be read as consistent with and as support for the following claims, which are to have their fullest and fairest scope.

We claim:

1. An assembly for controlling delivery of downhole treatment fluid to a location in a well, the assembly comprising:

a tubular body defining a space therein for accommodating the treatment fluid;

a spot valve coupled to a downhole end of said tubular body for managing the flow of treatment fluid into the space of the tubular body; and a backpressure valve coupled to a downhole end of said spot valve for the controlling, wherein said backpressure valve is of a pressure rating greater than said spot valve.

2. The assembly of claim 1 wherein the managing comprises directing filling of said tubular body with the treatment fluid.

3. The assembly of claim 1 wherein said tubular body comprises coiled tubing.

4. The assembly of claim 1 wherein said backpressure valve is a first backpressure valve, the assembly further comprising a second backpressure valve coupled to a downhole end of said first backpressure valve for increasing the controlling.

5. The assembly of claim 1 wherein said spot valve is of a pressure rating of less than about 1,000 psi.

6. The assembly of claim 1 wherein said backpressure valve is of a pressure rating between about 2,000 psi and about 5,000 psi.

7. The assembly of claim 1 wherein the assembly is configured to be loaded with treatment fluid from the downhole end thereof.

8. An assembly for delivering a treatment fluid to a target location in a well, the assembly comprising:

a tubular body for accommodating a driving fluid and the treatment fluid as a fluid column of increasing pressure;

a spot valve coupled to a downhole end of said tubular body for directing the treating fluid of the column thereinto, downhole of the driving fluid; and a backpressure valve coupled to a downhole end of said spot valve for retaining the treatment fluid at the increasing pressure in advance of the delivering at the target location, wherein the back pressure valve is configured to avoid premature release of treatment fluid from the assembly, wherein the assembly is configured to be loaded with treatment fluid from the downhole end thereof.

9. The assembly of claim 8 further comprising a pig assemblage disposed in said tubular body for isolating the treatment fluid form the driving fluid.

10. The assembly of claim 9 wherein said pig assemblage comprises:

an uphole pig for sealably interfacing the driving fluid;

a downhole pig for sealably interfacing the treatment fluid; and a guiding ball disposed between said pigs.

11. The assembly of claim 10 further comprising a delivery stop seat disposed in said tubular body uphole of said spot valve for interfacing said guiding ball to cease the delivering.

12. A well treatment system comprising:

an assembly with a spot valve for one way filling coupled to a backpressure valve configured for retaining, said assembly for delivering the treatment fluid to a downhole location in a well; and coiled tubing equipment coupled to said assembly for positioning at the downhole location, said equipment including coiled tubing to accommodate the treatment fluid in advance of the positioning and the delivering, wherein the treatment fluid is filled from a downhole end of the assembly such that the majority of the interior of the coiled tubing is not in contact with the treatment fluid.

13. The well treatment system of claim 12 wherein the downhole location is of a depth exceeding about 15,000 ft.

14. The well treatment system of claim 12 wherein the treatment fluid is cement.

15. The well treatment system of claim 14 wherein the treatment location is defined by a packer positioned adjacently downhole thereof.

16. The well treatment system of claim 14 wherein the delivering occludes a perforation at the donwhole location.

17. A method of delivering a treatment fluid to a downhole location in a well, the method comprising:

opening a spot valve of a tubular assembly to load the assembly with the treatment fluid; and coupling a backpressure valve to the spot valve for retaining the treatment fluid in the assembly in advance of the delivering deploying the assembly to the location;

supplying sufficient fluid pressure through the assembly to overcome the backpressure valve and achieve the delivering; and ceasing said supplying in response to a spike in fluid pressure within the tubular assembly.

18. The method of claim 17 wherein the backpressure valve is a first backpressure valve, said coupling further comprising securing a second backpressure valve to said first backpressure valve for on-site customized control of the retaining.

19. The method of claim 17 wherein the treatment fluid is cement for occluding a portion of the well.

20. The method of claim 19 wherein the portion includes one of a perforation at a wall of the well and a region of the well downhole of the location.

21. The method of claim 20 wherein the portion includes the perforation, the method further comprising milling through the cement following the delivering to provide access to the region.

22. The method of claim 17 wherein the treatment fluid is loaded into the assembly from the downhole end of the tubular assembly.

* * * * *